United States Patent [19]

Pfeffer et al.

[11] Patent Number: 4,979,427

[45] Date of Patent: Dec. 25, 1990

[54] TEMPERATURE-SENSITIVE VARIATION OF THE COMPRESSION RATIO IN PISTONS HAVING VARIABLE COMPRESSION HEIGHT

[75] Inventors: Viktor Pfeffer, Ostfildern; Friedrich Wirbeleit, Stuttgart; Klaus Binder, Deizisau, all of Fed. Rep. of Germany

[73] Assignee: Daimler-Benz AG, Fed. Rep. of Germany

[21] Appl. No.: 317,912

[22] Filed: Mar. 3, 1989

[30] Foreign Application Priority Data

Mar. 5, 1988 [DE] Fed. Rep. of Germany ..... 3807244

[51] Int. Cl.[5] ..... F01B 31/14

[52] U.S. Cl. ..... 92/60.5; 92/82; 92/110; 92/143; 123/48 B; 123/78 B

[58] Field of Search ..... 92/60.5, 109, 110, 143, 92/208, 237, 82; 123/48 B, 78 B

[56] References Cited

U.S. PATENT DOCUMENTS

| | | | |
|---|---|---|---|
| 3,303,831 | 2/1967 | Sherman | 92/82 |
| 3,418,982 | 12/1968 | Waugaman | 123/78 B |
| 3,450,113 | 6/1969 | Bachle | 123/78 B |
| 3,527,264 | 9/1970 | Bachle | 123/48 B |
| 3,656,412 | 4/1972 | Wilson | 92/82 |
| 4,016,841 | 4/1977 | Karaba et al. | 123/78 B |
| 4,031,868 | 6/1977 | Karaba et al. | 123/78 B |
| 4,079,707 | 3/1978 | Karaba et al. | 92/60.5 |
| 4,469,055 | 9/1984 | Caswell | 92/82 X |
| 4,784,093 | 11/1988 | Pfeffer et al. | 123/78 B |
| 4,809,650 | 3/1989 | Arai et al. | 123/78 B |
| 4,864,977 | 9/1989 | Hasegawa | 123/48 B |
| 4,934,347 | 6/1990 | Suga et al. | 123/48 BX |

*Primary Examiner*—John T. Kwon
*Assistant Examiner*—John Ryznic
*Attorney, Agent, or Firm*—Evenson, Wands, Edwards, Lenahan & McKeown

[57] ABSTRACT

The invention relates to a piston having a variable compression height and two control chambers connected to each other through a hydraulic system. In order to achieve better cold-start and warm-up behavior, an oil discharge bore from the upper control chamber into the crankcase is closed by a control slide valve in the cold operating state of the engine. The blockage of the oil discharge produces a great compression height and therefore high compression. The control slide valve is connected to an expansible element which maintains it in this closed position when the engine is cold. As the engine warms up, the expansible element, due to its thermal expansion, pushes the control slide valve out of its closed position, so that the discharge of oil can occur progressively more unthrottled with rising temperature. In the warm operating state of the engine the control slide valve clears the oil discharge duct completely, and an unobstructed discharge of oil is ensured.

4 Claims, 2 Drawing Sheets

TEMPERATURE-SENSITIVE VARIATION OF THE COMPRESSION RATIO IN PISTONS HAVING VARIABLE COMPRESSION HEIGHT

BACKGROUND AND SUMMARY OF THE INVENTION

The invention relates to a control device for controlling the flow of oil to and from two control chambers of a piston having variable compression height and comprising an outer piston part and an inner piston part guided axially slidably relative to the outer piston part and articulated to a connecting-rod, the two control chambers being formed axially opposite one another and separated by the inner piston part, the first control chamber being arranged between a first surface of the inner piston part and a surface of the outer piston which faces a piston crown, and the second control chamber being arranged between a second surface of the inner piston part and a surface which faces a shank of the outer piston part.

Pistons having variable compression height are known and described in "MTZ Motortechnische Zeitschrift 47 (1986) 5" for example. Pistons of this type exhibit an inner piston part connected positively to the crankshaft and an outer piston part connected frictionally to it through a hydraulic system, and arranged slidably on the inner piston part. Two control chambers connected by oil bores are arranged between the inner piston part and the outer piston part.

During the exhaust stroke the outer piston part is drawn by inertia, so that a pressure increase is caused in the lower control chamber. This causes oil to flow through a throttle from the lower into the upper control chamber. In addition, the increase in volume of the upper control chamber causes a flow of oil from the gudgeon pin through a nonreturn valve into said control chamber. The result is an increase in the compression height of the piston.

After the mixture has ignited in the combustion chamber, resulting in an increase in gas pressure, this gas pressure is transmitted to the upper control chamber and delivers oil under control through a pressure limiter valve into the crankcase. Oil flows simultaneously from the upper control chamber through a throttle and through a nonreturn valve into the lower control chamber. The volume of the upper control chamber, and hence the compression height, are reduced in this manner.

However, a reduction of the compression height during combustion is undesirable during the cold-start and the warm-up phase, and is disadvantageous due to less favorable ignition conditions and a longer warm-up phase with increased toxic emission.

Starting from the prior art, it is an object of the invention to construct a device of the generic type so that the operating behavior of the internal-combustion engine is improved by maintaining a great compression height during the cold-start and in the warm-up phase.

This object is achieved according to the invention by providing an arrangement wherein said oil flow control device comprises:

a first oil bore in the inner piston part which connects the first control chamber to an oil supply means and contains a nonreturn valve which opens towards the first control chamber, a second oil bore in the inner piston part which connects the first control chamber to a crankcase and which contains a pressure limiter valve which opens towards the crankcase, a third oil bore in the inner piston part with the purpose of controlling the flow of oil between the two control chambers, and a control element which closes the second oil bore when the engine is cold and clears it in the warm operating state of the engine.

In especially preferred embodiments the control element is an expansible element which exhibits minimal length in the cold start and has a control slide valve connected to it.

In a piston of the above-described type a control element is inserted in the run of the oil bore between the upper control chamber and the crankcase. This control element consists of a control slide valve which closes the oil bore when the engine is cold to thereby prevent the discharge of oil from the upper control chamber into the crankcase and thus provide a constant compression height. As the operating temperature of the engine rises the control slide valve gradually clears the flow of oil again through the oil bore after ignition of the mixture and resulting pressure rise in the upper control chamber, so that a reduction of the compression height can occur. The control slide valve is connected mechanically to an expansible element fastened in the inner piston part, so that when the engine is cold the expansible element maintains the control slide valve in such a position that the oil bore is completely closed by the control slide valve. With rising engine operating temperature, the expansible element, due to its change in dimension, moves the control slide valve out of the oil bore so that a control of the discharge of oil through the oil bore into the crankcase occurs. In the warm operating state of the engine the control slide valve has assumed a position in which the oil bore cross-section is fully cleared.

With the control device of the present invention, improved starting behavior is obtained when the engine is cold, and reduced toxic emission is achieved by shortening the warm-up phase.

Other objects, advantages and novel features of the present invention will become apparent from the following detailed description of the invention when considered in conjunction with the accompanying drawings.

DETAILED DESCRIPTION OF THE DRAWINGS

Figure 1:
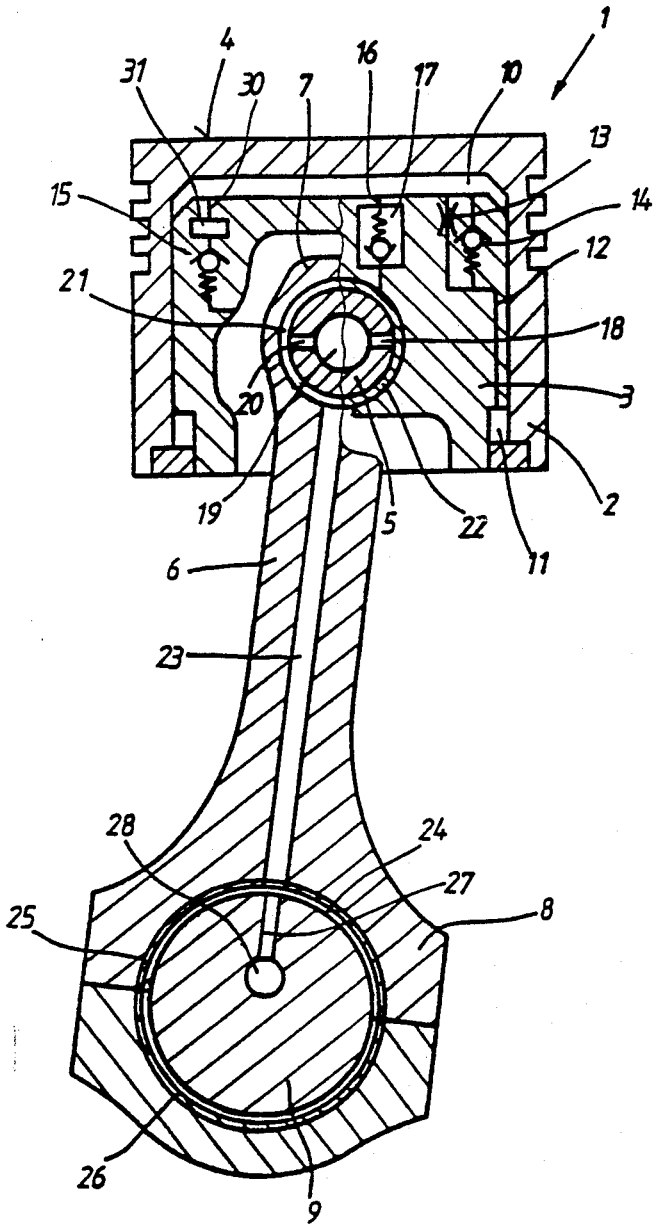
FIG. 1 is a schematic longitudinal sectional view which shows a piston/connecting rod arrangement constructed according to a preferred embodiment of the invention.

A piston having a variable compression height, designated 1 in FIG. 1, comprises an outer piston part 2 and an inner piston part 3. The outer piston part 2 includes the piston skirt and the piston crown 4 and is retained on the inner piston part 3 slidably in the axial direction of the piston 1. According to the longitudinal section shown to the right of the longitudinal median axis, the inner piston part 3 has inserted in it in two bolt eyes a gudgeon pin 5, to which a connecting-rod 6 is articulated by its small-end hole 7. The connecting-rod 6, conjointly with the piston 1, is mounted by a big-end bearing 8 on a crank pin 9 of a crankshaft, not further shown.

An upper control chamber 10, which is enclosed between the outer piston part 2 and the inner piston part 3, is connected to a lower control chamber 11 by a communicating bore 12, in which a throttle 13, and a nonreturn valve 14 in parallel with the latter, are arranged.

Both the control chambers 10 and 11 are filled with oil from the lubricating oil circuit. The compression height variation is produced by the force—resulting from gas force, mass force and friction forces—which acts upon the outer piston part 2, oil being displaced from one control chamber to the other. During the reduction of the compression height, oil is displaced from the upper control chamber 10 through the oil bore 30 and the pressure limiter valve 15 into the crankcase. The increasing volume in the lower control chamber 11 is filled through the throttle 13 and the nonreturn valve 14.

During the increase of the compression height, oil is forced from the lower control chamber 11 through the throttle 13, and especially from the gudgeon pin 5 through the nonreturn valve 17, into the upper control chamber 10.

An inlet bore 16, which leads into a groove, not shown, in the inner piston part 3, is present in the inner piston part 3 to supply oil to the upper control chamber 10. A nonreturn valve 17, which is inserted in the run of the inlet bore 16, blocks the discharge of oil from the control chamber 10. The groove in the inner piston part 3 is connected by a bore 18 to the interior space 19 of the hollow bored gudgeon pin 5. The interior space 19 then forms an oil reservoir, from which oil can be removed continuously in the upward regulating phase. The interior space 19 is connected by a further bore 20 to an oil groove 21 in the bearing bushing 22 of the small-end hole 7. The oil groove 21 is in turn in communication with a longitudinal bore 23 in the connecting rod 6, which leads into a control oil groove 24 in the big-end bearing 8. The control oil groove 24 may be provided in both bearing shells 25 and 26 of the big-end bearing 8. The connection to the main oil bore 28 of the lubricating oil circuit is effected through a transverse bore 27 in the crank pin 9.

Figure 2:
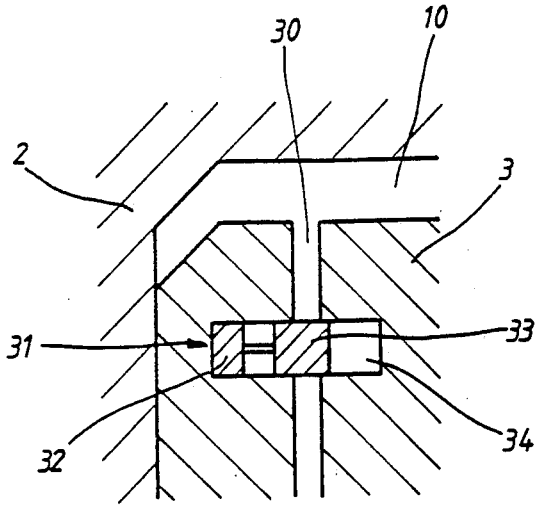
FIG. 2 shows on a larger scale a detail from FIG. 1 when the engine is cold.

FIG. 2 shows a detail from FIG. 1 on a larger scale, namely for the cold operating state of the engine. The inner piston part is again designated 3, and the upper control chamber 10 is located above the latter 10. As in FIG. 1, the outer piston part is designated 2. The oil bore 30 is shown starting from the upper control chamber 10, passing through the inner piston part 3 by way of a pressure limiter valve, not shown here, to the crankcase. A control element 31 which is provided in the run of this oil bore 30 comprises an expansible element 32 fitted in the inner piston part 3 and a control slide valve 33 connected mechanically to the latter. The control slide valve 33, which is slidable in its guide means 34, is attached to the expansible element 32, which exhibits a minimum length expansion in the cold operating state of the engine, in such a way that it completely closes the oil bore 30 in this state. In this state, therefore, the discharge of oil from the upper control chamber 10 into the crankcase is prevented, so that the compression height remains unchanged and a high compression ratio therefore exists. High final compression temperatures, which are obtained by this means, produce favorable flash point and flame propagation conditions for the cold-start phase.

With rising engine operating temperature, the expansible element 32 begins to repel the control slide valve 33 attached to it out of the oil bore 30 in its guide means 34 due to its temperature-dependent longitudinal expansion, and thus gradually to clear the cross-section of the oil bore 30 and to permit a discharge of oil, although throttled, from the upper control chamber 10 into the crankcase. In this way the regulation of the compression ratio, which is desirable for a piston having a variable compression height, can commence gradually with the warming-up of the engine.

Due to the desired increased compression ratio in the warm-up phase, not only are favorable combustion conditions achieved, as mentioned above, but the warm-up phase is also shortened and the toxic emission, particularly the unburnt hydrocarbons, is therefore reduced.

Figure 3:
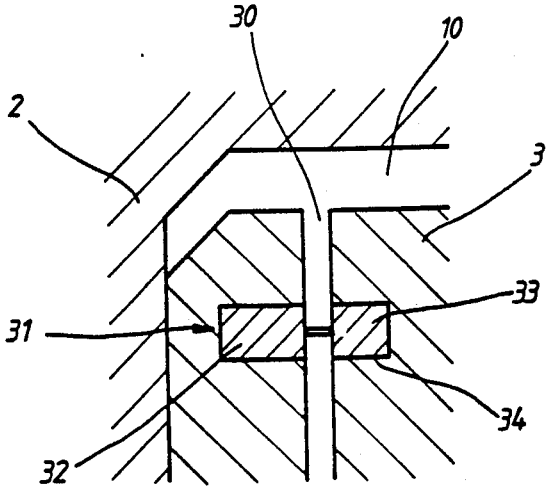
FIG. 3 shows on a larger scale the same detail from FIG. 1 when the engine is in the warm operating state.

FIG. 3 shows the arrangement according to FIG. 2, but in the warm operating state. The construction is identical to FIG. 2, and the reference numerals of both figures conform.

In this operating state of the engine, the expansible element 32 has attained its maximum length extension. Due to the firm connection between expansible element 32 and control slide valve 33, the latter is slid so far in its guide means 34 that it clears the entire cross-section of the oil bore 30. During a reduction in the compression height, oil can be discharged unthrottled from the upper control chamber 10 in the oil bore 30 through a pressure limiter valve, not shown here, into the crankcase, likewise not shown here. The normal operation of a piston having variable compression height is ensured in this state.

The device described here is applicable without restriction to mixture-compression and also to air compression internal-combustion engines. Within the ambient of the invention, the arrangement of the control element 31 may be made both upstream or downstream of the pressure limiter valve 15. It is also conceivable to combine the pressure limiter valve with the control element to form a single component.

Although the present invention has been described and illustrated in detail, it is to be clearly understood that the same is by way of illustration and example only, and is not to be taken by way of limitation. The spirit and scope of the present invention are to be limited only by the terms of the appended claims.

What is claimed:

1. Oil flow control device for controlling the flow of oil to and from two control chambers of a piston of an engine, said piston having a variable compression height and comprising an outer piston part and an inner piston part guided axially slidably relative to the outer piston part and articulated to a connecting-rod, the two control chambers being formed axially opposite one another and separated by the inner piston part, the first control chamber being arranged between a first surface of the inner piston part and a surface of the outer piston part which faces a piston crown, and the second control chamber being arranged between a second surface of the inner piston part and a surface which faces a shank of the outer piston part, wherein said oil flow control device comprises:

a first oil bore in the inner piston part which connects the first control chamber to an oil supply means and contains a non-return valve which opens towards the first control chamber, a second oil bore in the inner piston part which connects the first control chamber to a crankcase and which contains a pressure limiter valve which opens towards the crankcase, a third oil bore in the inner piston part with the purpose of controlling the flow of oil between the two control chambers, and a control element which closes the second oil bore when the engine is cold and clears it in a warm operating state of the engine.

2. Device according to claim 1, wherein the control element is an expansible element which exhibits minimal length in the cold state and has a control slide valve connected to it.

3. Device according to claim 1, wherein said second oil bore extends in an axial direction of the piston, and wherein said control element moves transversely of said second oil bore in response to changing operating temperatures of the piston.

4. Device according to claim 2, wherein said control element moves transversely of said second oil bore in response to changing operating temperatures of the piston.

* * * * *